US005717446A

United States Patent [19]

Teumer et al.

[11] Patent Number: 5,717,446

[45] Date of Patent: Feb. 10, 1998

[54] LIQUID INK PRINTER INCLUDING A VACUUM TRANSPORT SYSTEM AND METHOD OF PURGING INK IN THE PRINTER

[75] Inventors: Roger G. Teumer, Fairport; Thomas N. Taylor, Rochester; Brian S. Hilton, Webster, all of N.Y.

[73] Assignee: Xerox Corporation, Stamford, Conn.

[21] Appl. No.: 353,862

[22] Filed: Dec. 12, 1994

[51] Int. Cl.[6] ..... B41J 2/165; B41J 2/01

[52] U.S. Cl. ..... 347/35; 347/102; 347/104

[58] Field of Search ..... 347/104, 35, 22, 347/102; 271/7, 197, 198, 275, 276

[56] References Cited

U.S. PATENT DOCUMENTS

| | | | |
|---|---|---|---|
| 4,207,578 | 6/1980 | Marinoff | 347/35 |
| 4,469,026 | 9/1984 | Irwin | 101/426 |
| 4,651,173 | 3/1987 | Ozawa et al. | 347/104 |
| 5,040,000 | 8/1991 | Yokoi | 347/30 |
| 5,124,728 | 6/1992 | Denda | 346/134 |
| 5,214,442 | 5/1993 | Roller | 347/102 |
| 5,349,905 | 9/1994 | Taylor et al. | 101/488 |

FOREIGN PATENT DOCUMENTS

| | | | |
|---|---|---|---|
| 3-92358 | 4/1991 | Japan | 347/35 |

OTHER PUBLICATIONS

Friday, Bruce W., 'Transfer Apparatus', "Xerox Disclosure Journal", vol. 1, No. 7, pp. 67–68, Jul. 1976.

*Primary Examiner*—David F. Yockey
*Attorney, Agent, or Firm*—Daniel J. Krieger

[57] ABSTRACT

In a liquid ink printer transport belt located between a liquid ink printhead and a vacuum holddown device includes apertures for applying a vacuum to the recording medium and for enabling the liquid ink printhead to purge ink through the apertures in the absence of the recording medium without slowing or stopping the belt. The vacuum holddown device includes a platen located beneath the belt for applying a vacuum through the apertures and gutters or slots for collecting ink from the liquid ink printheads during printing. The combination of belt and platen or apertures and gutters or slots provides continuous communication of the vacuum to the recording media as the belt moves across the platen and through a dryer. The transport belt enables the use of a single transport for both imaging and drying.

17 Claims, 8 Drawing Sheets

LIQUID INK PRINTER INCLUDING A VACUUM TRANSPORT SYSTEM AND METHOD OF PURGING INK IN THE PRINTER

FIELD OF THE INVENTION

This invention relates generally to printing in a liquid ink printer and more particularly to transporting recording sheets through drop-on-demand or continuous stream type printers.

BACKGROUND OF THE INVENTION

Liquid ink printers of the type frequently referred to continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. Power pulses cause the droplets of ink to be expelled as required from orifices or nozzles at the end of the channels. Continuous ink stream printers are also known.

In a thermal ink-jet printer, the power pulses are usually produced by resistors, each located in a respective one of the channels, which are individually addressable to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink thereby forming a droplet moving in a direction away from the channel orifice and towards the recording medium whereupon hitting the recording medium a spot is formed. The channel is then refilled by capillary action, which, in turn, draws ink from a supply container of liquid ink. Operation of a thermal ink-jet printer is described in, for example, U.S. Pat. No. 4,849,774.

The ink-jet printhead may be incorporated into either a carriage-type printer or a page-width type printer. The carriage-type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. The procedure is repeated until the entire page is printed. In contrast, the page-width printer includes a stationary printhead having a length equal to or greater than the width or length of a sheet of recording medium. The paper is continually moved past the page-width printhead in a direction substantially normal to the printhead length and at a constant or varying speed during the printing process. A page-width ink-jet printer is described, for instance, in U.S. Pat. No. 5,192,959.

It has been recognized that there is a need to maintain the ink ejecting nozzles of liquid ink printheads, such as an ink-jet printhead, by periodically cleaning the orifices when the printhead is in use by purging or vacuum withdrawal of ink and/or by capping the printhead when the printer is out of use or is idle for extended periods. The capping of the printhead is intended to prevent the ink in the printhead from drying out. There is also a need to prime or to purge the printhead nozzles before use and occasionally during use to ensure that the printhead channels are completely filled with ink, contain no contaminants or air bubbles, and do not dry out from not being used. Typically, the ink-let printhead is moved into position or vice versa with a maintenance and/or priming station for printheads of ink-jet printers. In a page-width printhead, the maintenance of the nozzles throughout the entire length of the printhead is especially critical since not all of the individual jets may be fired during the printing of a single sheet of paper or over many sheets of paper.

In addition to being able to properly maintain the ink-ejecting nozzles of a page-width printhead, it is also essential that the recording sheet passes the page-width printhead spaced a predetermined distance therefrom. Consequently, while page-width printheads are desirable for printing sheets rapidly, as opposed to carriage type printers, the problems of maintaining the individual nozzles and of maintaining the correct position of the recording sheet during printing require particular attention.

Various ink-jet printers and mechanisms for moving a recording sheet beneath an ink-jet printhead and for maintaining the nozzles of an ink-jet printhead are illustrated and described in the following disclosures which may be relevant to certain aspects of the present invention.

U.S. Pat. No. 4,469,026 to Irwin describes a method and apparatus for controlling drying and detaching of printed material. A plurality of conveying belts transport sheet material past a dryer.

U.S. Pat. No. 5,040,000 to Yokoi, describes an ink-jet recording apparatus having a space saving ink recovery system. The ink-jet recording apparatus includes a recording head and a head recovery device provided in a position opposite to the discharge ports of the recording head. A conveying belt for conveying a recording medium between the ink-jet printhead and the head recovery device includes an opening so that the head recovery device can be moved into contacting position with the recording head.

U.S. Pat. No. 5,124,728 to Denda, describes an ink-jet recording apparatus having a vacuum platen. A flat section of the platen includes a plurality of opening holes through which a vacuum device creates a vacuum to attract a recording medium onto the flat section of the platen. The dimensions or the density of the opening holes is gradually reduced so as to compensate for differences in width of the recording media to thereby effectively avoid the floating of a medium.

U.S. Pat. No. 5,214,442 to Roller describes an adaptive dryer control for ink jet processors. The adaptive dryer minimizes heating power requirements of a printer by determining mass-area coverage of ink on a page prior to drying.

U.S. Pat. No. 5,349,905 to Taylor et al. describes a method and apparatus for controlling peak power requirements of a printer. The speed of the sheet transport system is controlled in accordance with the image density.

SUMMARY OF THE INVENTION

In accordance with one aspect of the present invention, there is provided a printing machine for printing on a recording medium moving along a path. The printing machine includes a liquid ink printhead adapted to deposit ink on the recording medium, and a transport belt disposed adjacently to the printhead. The transport belt moves the recording medium along the path and defines a plurality of apertures through which the liquid ink printhead ejects ink in the absence of the recording medium.

In accordance with another aspect of the invention, there is provided a method of purging an ink jet printhead in a printing machine having a transport belt with apertures and moving printing sheets through a print zone. The method includes the step of ejecting ink through the apertures of the transport belt during movement thereof.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
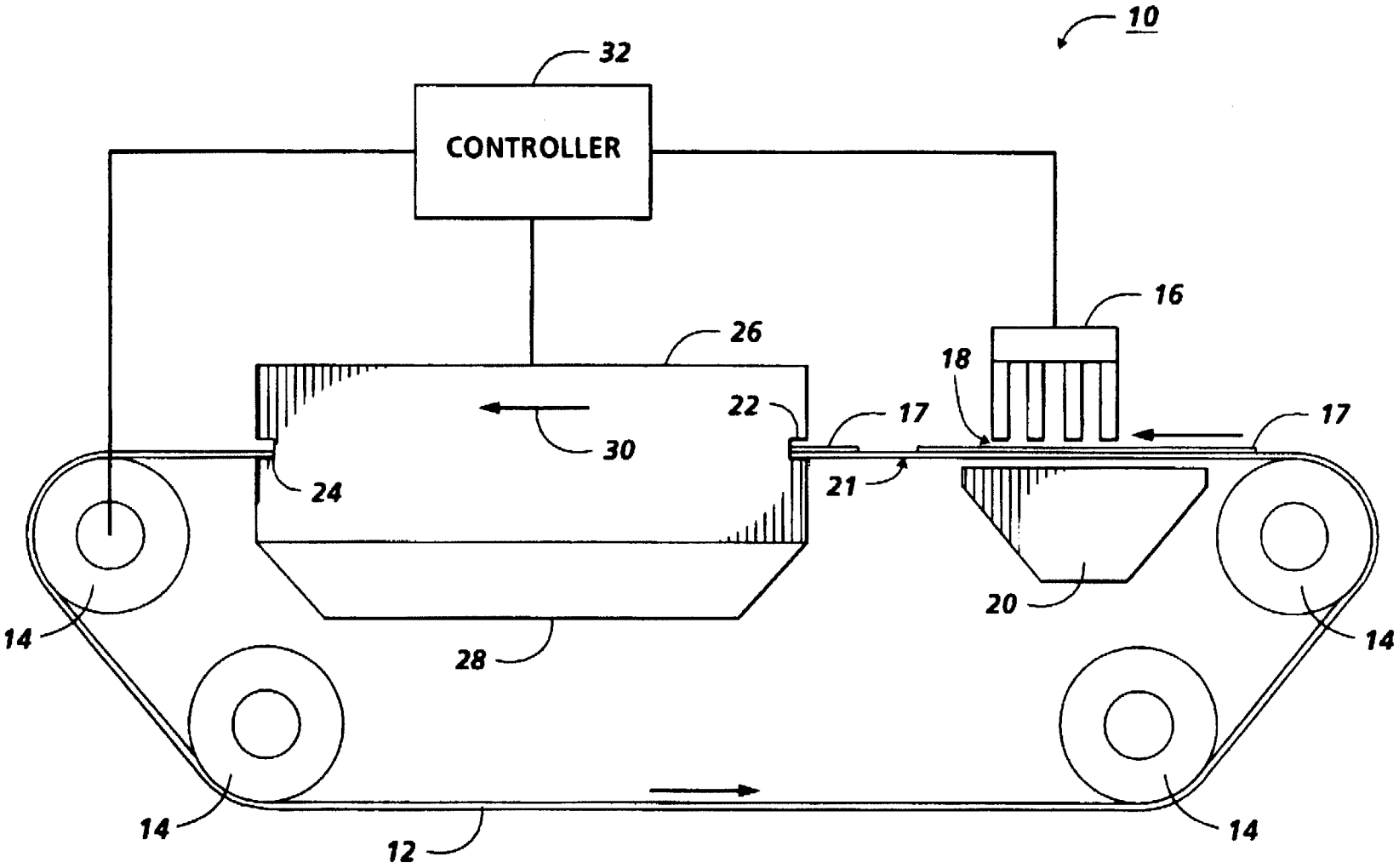
FIG. 1 is a schematic side elevational view of one embodiment of an ink-jet printer incorporating the present invention.

FIG. 1 illustrates a schematic side view of an ink-jet printer 10. The ink-jet printer 10 includes an input tray (not shown) containing cut sheets of paper stock or transparencies to be printed on by the ink-jet printer. Individual recording sheets are removed from the input tray and fed onto a transport belt 12 driven by rollers 14 beneath a printing member 16. The transport belt 12 is substantially transparent to microwave energy and includes a plurality of holes through which a vacuum is applied to hold the printing sheet to the belt as it moves through the printer. Suitable materials include ULTEM, a polyetherimide, available from General Electric, KALADEX, a polyethylene napthalate, available from Imperial Chemical Industries (ICI) of Wilmington, Del., and other materials substantially transparent to microwave energy that can be formed into a belt. The printing member 16 includes one or more page width ink-jet printheads which deposit liquid ink on a sheet of paper or transparency or other printing media as the belt 12 carries the recording sheet past the printing member 16. As illustrated, the printing member 16 includes four page-width printbars for printing full color images comprised of the colors cyan, magenta, yellow, and black. Each of the page-width ink-jet printbars includes a linear array of print nozzles so that ink is deposited across the sheet. The present invention is equally applicable, however, to printers having an ink-jet printhead which moves across the sheet periodically in swaths, to form the image, to printers having staggered arrays of printheads or to printers having a single printbar. The print member 16 includes an ink supply which may either be located with the printhead itself or may be located elsewhere and connected to the printhead through an ink conduit. In addition to an ink supply, the print member 16 includes the necessary electronics to control the deposition of ink on the individual sheets.

During printing, a recording sheet 17 is held to the transport belt 12 through a printing zone 18, by an applied vacuum from a first vacuum applicator 20. An interdocument region 21 is located between recording sheets 17 in areas where the transport belt 12 is not in contact with the recording sheets 17. Once printed, the printed recording sheet 17 enters an input slot 22 and exits an output slot 24 of a dryer 26. The dryer 26 has attached thereto a second vacuum applicator 28 for further application of a vacuum to the recording sheet 17 through the belt 12 as it traverses through the dryer 26 in the process direction of an arrow 30. The transport belt enables the use of a single transport for both imaging and drying. It is also possible that a single vacuum applicator could be used in both the imaging region and the dryer 26. Once the recording sheet 17 has been dried by the dryer 26, it exits the output slot 24 and is deposited in an output tray (not shown).

A controller 32 controls the printing member 16, the dryer 26, and the rollers 14, as would be understood by one skilled in the art. In addition, an adaptive dryer control for controlling the speed of the belt 12 through the dryer 26 can also be used. U.S. Pat. No. 5,214,442 entitled "Adaptive Dryer Control for Ink-Jet Processors", assigned to Xerox Corporation, discloses such an adaptive dryer control and is hereby incorporated by reference.

In the present embodiment of the invention, the dryer 26 includes a microwave dryer applying microwave power to dry the ink deposited on the recording sheet 17. A microwave dryer suitable for use in the present invention is described in U.S. patent application Ser. No. 08/159,908 entitled "Apparatus and Method for Drying Ink Deposited By Ink-Jet Printing" assigned to Xerox Corporation and filed Nov. 30, 1993, the relevant portions of which are incorporated herein by reference. Since a microwave dryer is being used, inks specially formulated to absorb microwave power are preferred. Such inks may include compounds designed to couple with the microwave power for increasing the amount of heat conducted thereby. One such compound is an ionic compound, at least ionizable in the liquid vehicle. U.S. Pat. No. 5,220,346 entitled "Printing Processes with Microwave Drying" assigned to Xerox Corporation, discloses a suitable ink and is hereby incorporated in this application by reference.

While ink-jet printing with page-width printheads provides for higher speeds of printing when compared to scanning carriage type of ink-jet printheads, it has been found that transporting printing sheets accurately and consistently past the page-width printhead 16 and through the microwave dryer 26 requires special considerations. In addition, to maintaining the throughput of the individual printed sheets, it is necessary that the page-width printheads 16 be purged quickly without moving the page-width printheads 16 away from the printing zone 18. Consequently, the present invention as described herein, provides a solution for the problems associated with transporting the recording sheets 17 past page-width thermal ink-jet printbars and printing therewith.

The present invention includes the ability to continuously hold down the print media through the print zone 18 and through the dryer 26 with a single, continuous transport system. In addition, the transport belt 12 allows for firing of all of the ink-jet nozzles through the belt in the absence of recording sheets such as in the interdocument region 21 to thereby prevent ink dryout which can clog the nozzles of the printhead 16. By firing through the belt, constant vacuum holddown is achieved, printer throughput is maintained, and cleaning of the transport belt is avoided. Likewise, the present invention enables the use of a single transport for both the imaging portions and drying portions of the printer 10.

Figure 2:
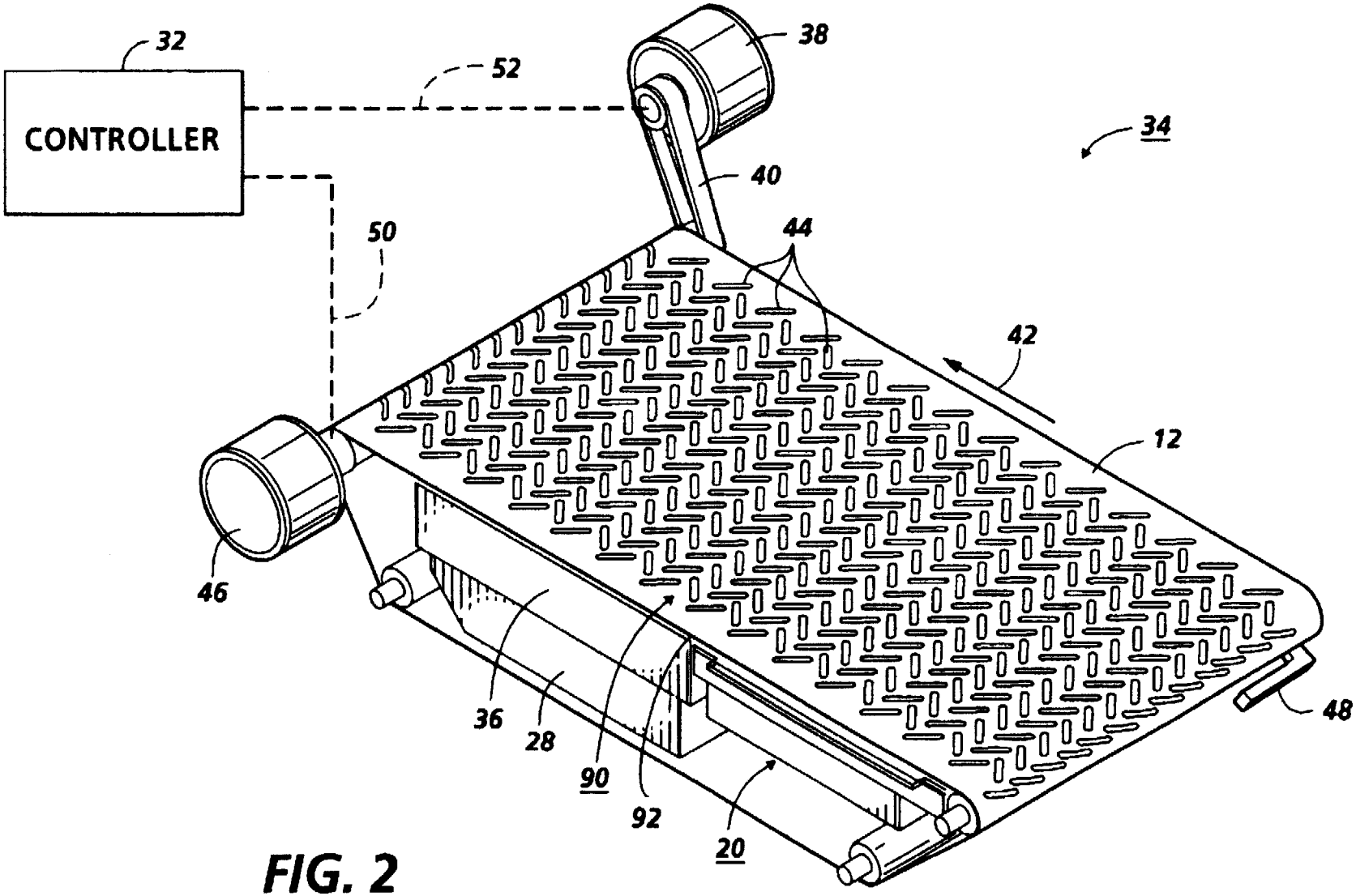
FIG. 2 is a schematic perspective view of one embodiment of a vacuum transport device including a vacuum transport belt system having apertures therein for ink-jet purging and vacuum holddown.

FIG. 2 illustrates an ink-jet vacuum transport system 34. The vacuum transport system 34 includes the belt 12, the first vacuum applicator 20, and the second vacuum application 28. A bottom half 36 of the microwave dryer 26 is also shown. A motor 38 is connected to one of the rollers 14 through a pulley 40 to thereby move the transport belt 12 in a process direction or transport belt direction 42. The belt 12 includes a plurality of apertures arranged in a pattern to enable the first vacuum applicator 20 and the second vacuum applicator 28 to apply vacuum holddown for the recording sheet 17 as it moves along the transport belt direction 42 beneath the printheads 16, through the printzone 18, and through the dryer 26. The second vacuum applicator 28 applies a vacuum through the bottom half 36 of the dryer 26 which includes a plurality of apertures 44 therein to enable the vacuum to pass through the apertures 44 to the sheet 17. Additionally, the plurality of apertures 44 provide openings through which a programmed ink-jet purging pattern can be fired by the ink-jet printhead 16 to thereby maintain the individual nozzles of each of the printheads.

An encoder 46 tracks the position of the belt 12 by a belt hole sensor 48 aligned with the anticipated locations of the apertures 44 moving in the transport direction 42. As the apertures 44 in the belt 12 pass the belt hole sensor 48, the encoder 46 receives the output of the sensor 48 and provides the appropriate signals to the controller 32 through a line 50. The encoder 46 and sensor 48 work in conjunction to provide the timing necessary for firing ink through the nozzles of the printbars relative to the lead edge of the recording sheet for printing or relative to the ink apertures 44 for purging of ink therethrough.

Figure 3:
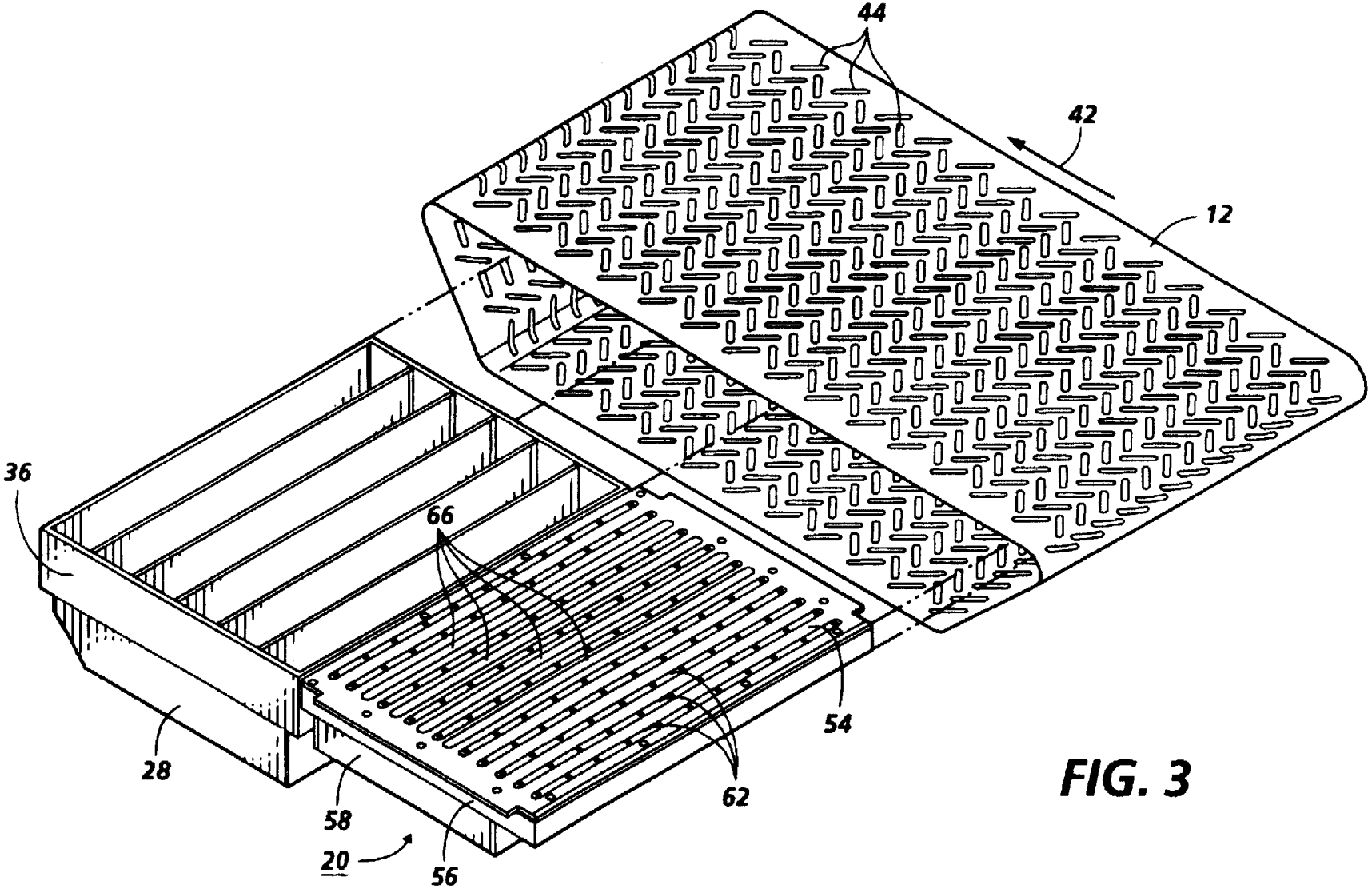
FIG. 3 is an exploded schematic perspective view of the embodiment illustrated in FIG. 2.

FIG. 3 illustrates an exploded schematic perspective view of the belt 12, the first vacuum applicator 20, the second vacuum applicator 28, and the bottom half 36 of the microwave dryer 26. The first vacuum applicator 20 includes a vacuum platen 54 which supports the belt 12 as the belt 12 moves through the printing zone 18. In addition to the vacuum platen 54, the first vacuum applicator 20 includes a first vacuum member 56 and a second vacuum member 58. The first vacuum member 56 and the second vacuum member 58 are connected to a vacuum generating apparatus (not shown).

Figure 4:
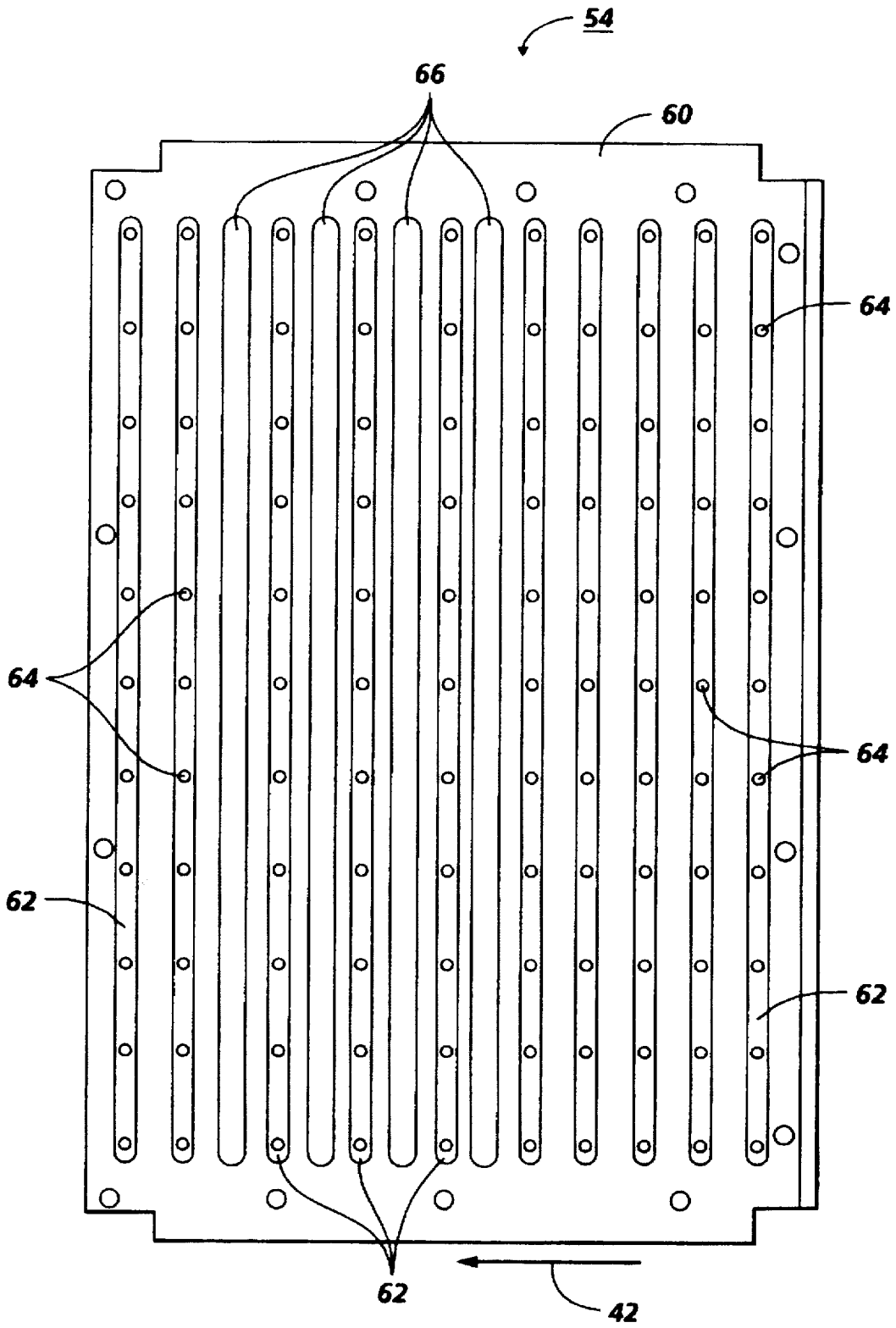
FIG. 4 is a schematic top plan view of a vacuum platen of the present invention.

As illustrated in FIG. 4, the vacuum platen 54, includes a substantially planar top surface 60 which contacts the belt 12 during operation. The top surface 60 includes a plurality of shallow grooves 62 extending across the top surface 60 for a length as long as or longer than the width of the recording sheet 17. The shallow grooves 62 include a plurality of holes or apertures 64 which extend through the platen 54. During application of a vacuum by the vacuum applicator 20, a vacuum is pulled or created through each of the individual holes or apertures 64 and consequently through the associated shallow groove 62 connected thereto for constant vacuum holddown. As the belt moves across the top surface 60 of the platen 54, the apertures 44 of the belt 12 move across the applied vacuum present in each of the grooves 62 and thereby direct the vacuum to the underneath side of the printing sheet 17. In the printing zone 18, during printing of paper, the vacuum also pulls through the porous paper to thereby draw any ink mist to the paper. The grooves 62 are spaced relative to the apertures 44 so that the applied vacuum is in constant, continuous communication with the recording sheet. In this fashion, the recording sheet 17 is held to the transport belt 12 as it moves through the print zone 18. Other spacings of grooves are also possible so that the recording sheet is in sufficient communication with the vacuum to effectively maintain recording sheet control.

In addition to the grooves 62 and the apertures 64, the platen 60 includes a plurality of elongated gutters or ink slots 66 which extend through the platen 54. The ink slots 66 have a length which is as long as or longer than the length of each of the array of nozzles within an individual printbar 16. As illustrated, there are four of the individual ink slots each of which is located beneath a corresponding one of the page-width printbars 16. During a purging operation, the printbars 16 eject ink in the interdocument region 21 through the apertures 44 of the moving belt 12 and correspondingly through the ink slots 66. Printbars are also purged in the absence of recording sheets. In this way, the individual page width printbars 16 can be maintained or purged during a printing operation without having to move the printbar 16 away from the print zone 18 or without having to stop the motion of the belt 12 to enable purging.

As can be seen in the illustration of FIG. 4, each of the ink slots 66 is separated by one of the shallow grooves 62. The size and spacing of the individual page-width printbars 16 is such that if the slots 62 were not located between adjacent printbar 16, it is likely that the recording sheets 17 could lose contact with the belt 12 through the print zone 18. Since printbar nozzle to recording sheet spacing is essential, the grooves 62 located between individual slots 66 provide a necessary vacuum holddown function in the present design. It is conceivable, however, that printheads spaced closer together than in the present embodiment would eliminate the need for having the grooves 62 located as presently described.

Figure 5:
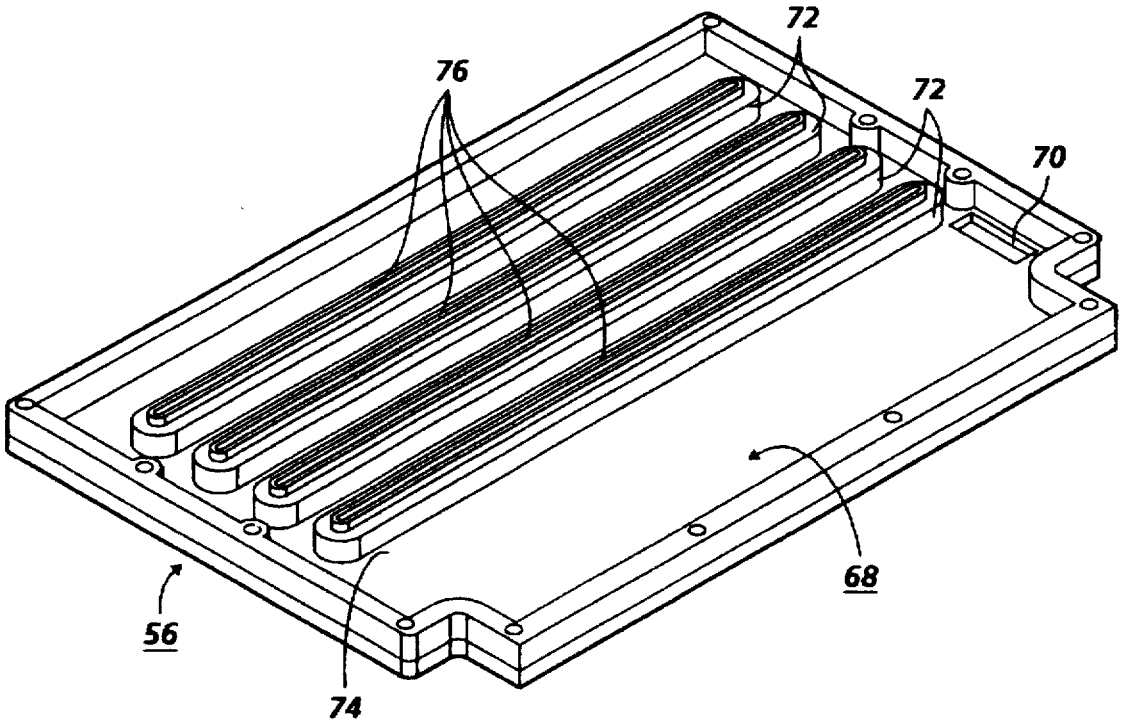
FIG. 5 is a schematic side elevational view of a first vacuum member including ink gutter slots.

FIG. 5 illustrates the first vacuum member 56 which subtends and supports the platen 54. The first vacuum member 56 defines a cavity 68 which defines a vacuum chamber when the vacuum generating apparatus is coupled to a vacuum duct 70. The vacuum cavity 68 extends throughout the interior of the first vacuum member 56 except for defined regions having a plurality of projections 72. The projections 72 extend from a floor 74 of the first vacuum member 56. The projections 72 define elongated gutter slots 76 which are coupled to the ink slots 66 of the platen 54 during operation. When the platen 54 is attached to the first vacuum member 56, the elongated gutter slots 76 communicate with the ink slots 66 to thereby convey ink ejected from the printhead 16 through the first vacuum member 56. The elongated gutter slots 76 are not subject to the vacuum which is created within the vacuum cavity 68 via the vacuum duct 70. The holes 64 of the platen 54, however, are in direct communication with the vacuum present within the vacuum cavity 68 which thereby provides the holddown feature for the recording sheet 17 during movement through the print zone 18.

Figure 6:
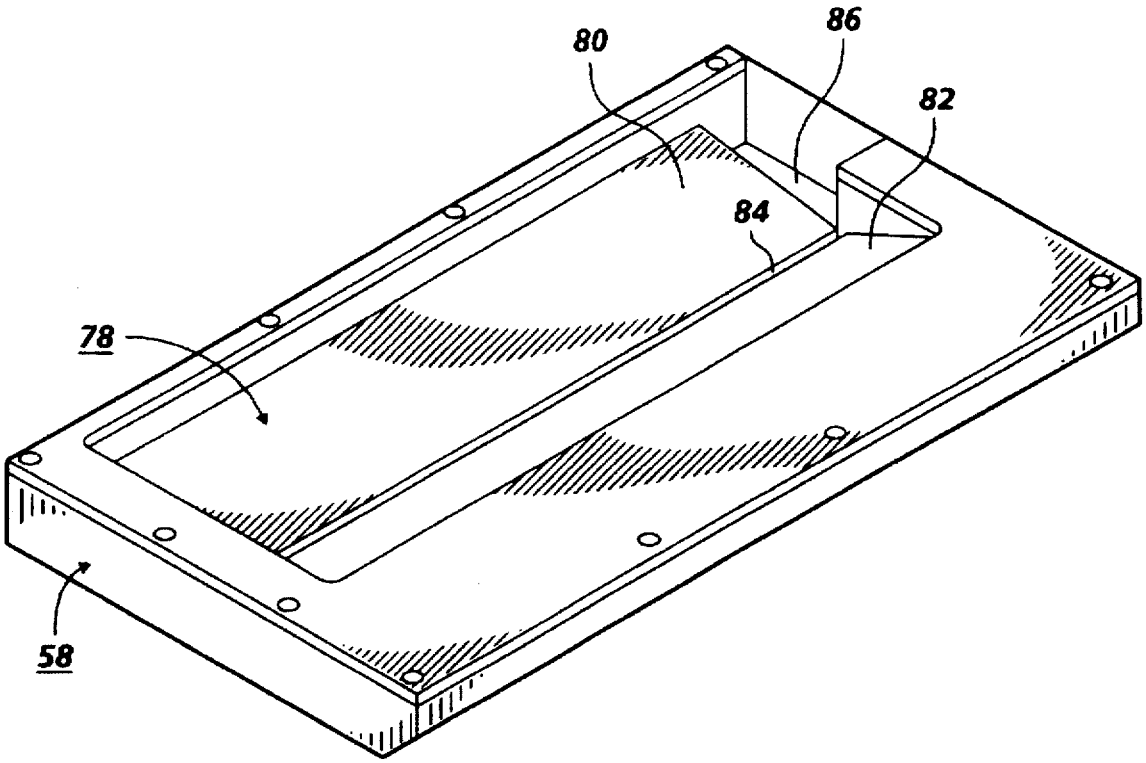
FIG. 6 is a schematic perspective view of a second vacuum member including an ink receiving portion for receiving ink ejected from the page-width printhead.

The elongated gutter slots 76 extend through the first vacuum member 56 and communicate with a vacuum cavity 78 of the second vacuum member 58 as illustrated in FIG. 6. The vacuum cavity 78 communicates with the elongated gutter slots 76 but not with the holes or apertures 64 present in the shallow grooves 62 of the platen 54. The vacuum cavity 78 is defined by a first angled side wall 80 and a second angled side wall 82 terminating in a groove 84 which receives ink ejected from the nozzles of the page-width printbars 16 through the elongated gutterslots 76. As ink is ejected from the page width printheads 16, the ink hits the angled side walls and flows into the groove 84 where the ink is collected. The second vacuum member 58 includes a vacuum duct 86 to which a vacuum supply is connected for generating a vacuum within the vacuum cavity 78. The vacuum present within the vacuum cavity 78 provides two functions: (1) to hold down the recording sheet 17 as it crosses the ink slots 66 of the platen 54 and (2) to pull the ink and any mist into the vacuum cavity 78 which is deposited through the slots during purging of the page width printheads 16.

Figure 7:
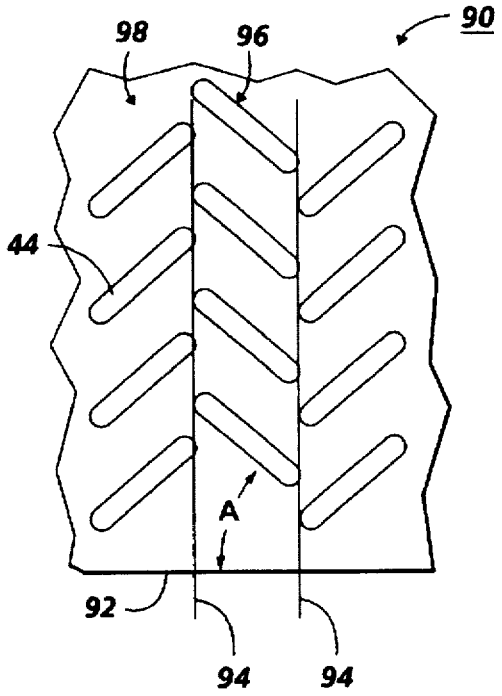
FIG. 7 is a schematic top plan view of a portion of the ink-jet vacuum transport belt.

FIG. 7 illustrates a portion 90 of the transport belt 12 as illustrated in FIG. 2. The portion 90 includes a plurality of the slots 44 which are angled with respect to a side edge 92 of the belt 12 which is also parallel to the process direction 42. The slots 44 are illustrated as elongated rectangles having rounded corners. It is also, however, possible that the individual slots 44 can be shaped as ovals or as rectangles having 90 degree corners. The slots are arranged in rows which extend across the width of the belt. The rows are parallel to a line 94 which is substantially perpendicular to the side edge 92. Each of the slots 44 within a single row are angled at the same amount with respect to the side edge 92. The angle of the individual slots within alternating rows changes between adjacently located rows. For instance, in this embodiment, each of the slots 44 within a row 96 are at an angle A of approximately 45 degrees with respect to the side edge 92. Each of the slots within a row 98 are at an angle B of approximately 135 degrees. These angles are not the only angles possible and other angles may be used.

Figure 8:
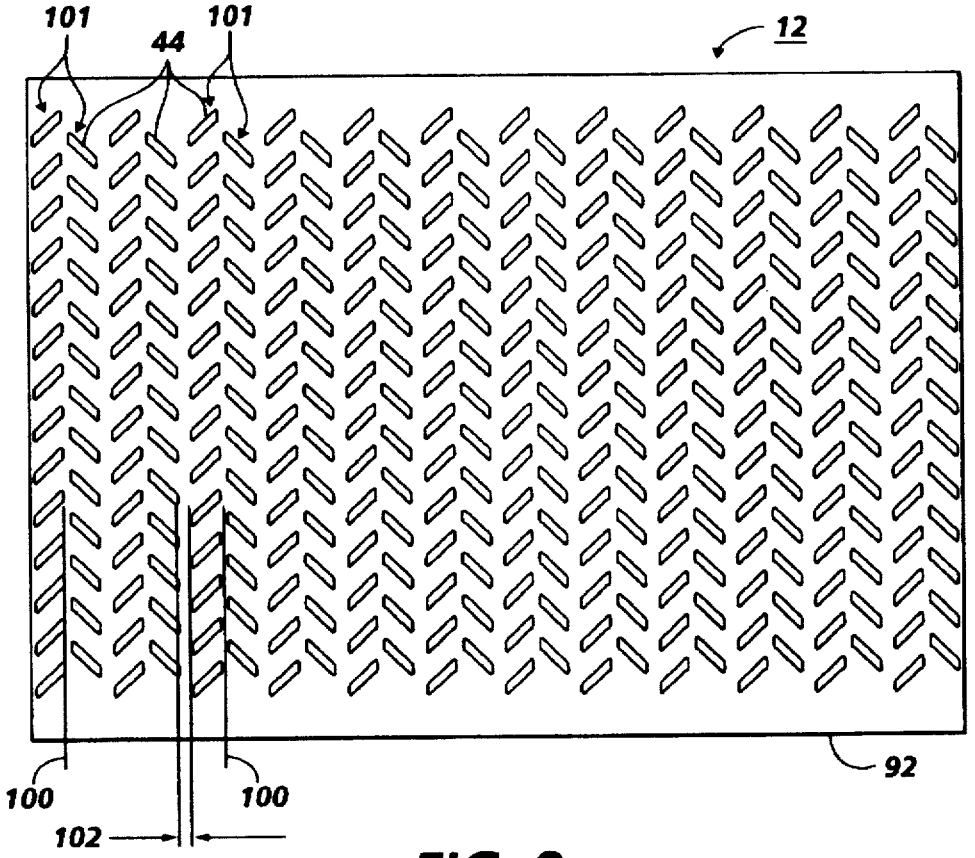
FIG. 8 is a top plan view of a second embodiment of an ink-jet transport belt.

FIG. 8 illustrates a plan view of another embodiment of the belt 12. The belt 12 has a hole pattern consisting of alternating rows of slots which are orthogonal to each other. As before, the individual slots are angled at approximately 45 degrees with respect to the belt edge 92. A pair of adjacent rows 101 of the slotted apertures 44 are spaced approximately 2 millimeters apart along a line 100 located perpendicularly to the transport direction 42. This spacing has been chosen to improve the integrity of the belt, but other spacings, or even contact along the line 100 of adjacent rows is possible. The pairs of adjacent rows 101 repeat along the transport direction 42 and are spaced from an adjacent pair of rows by a distance 102. Other patterns are also possible as long as the pattern provides for effective purging of the printbar during movement of the belt.

Figure 9:
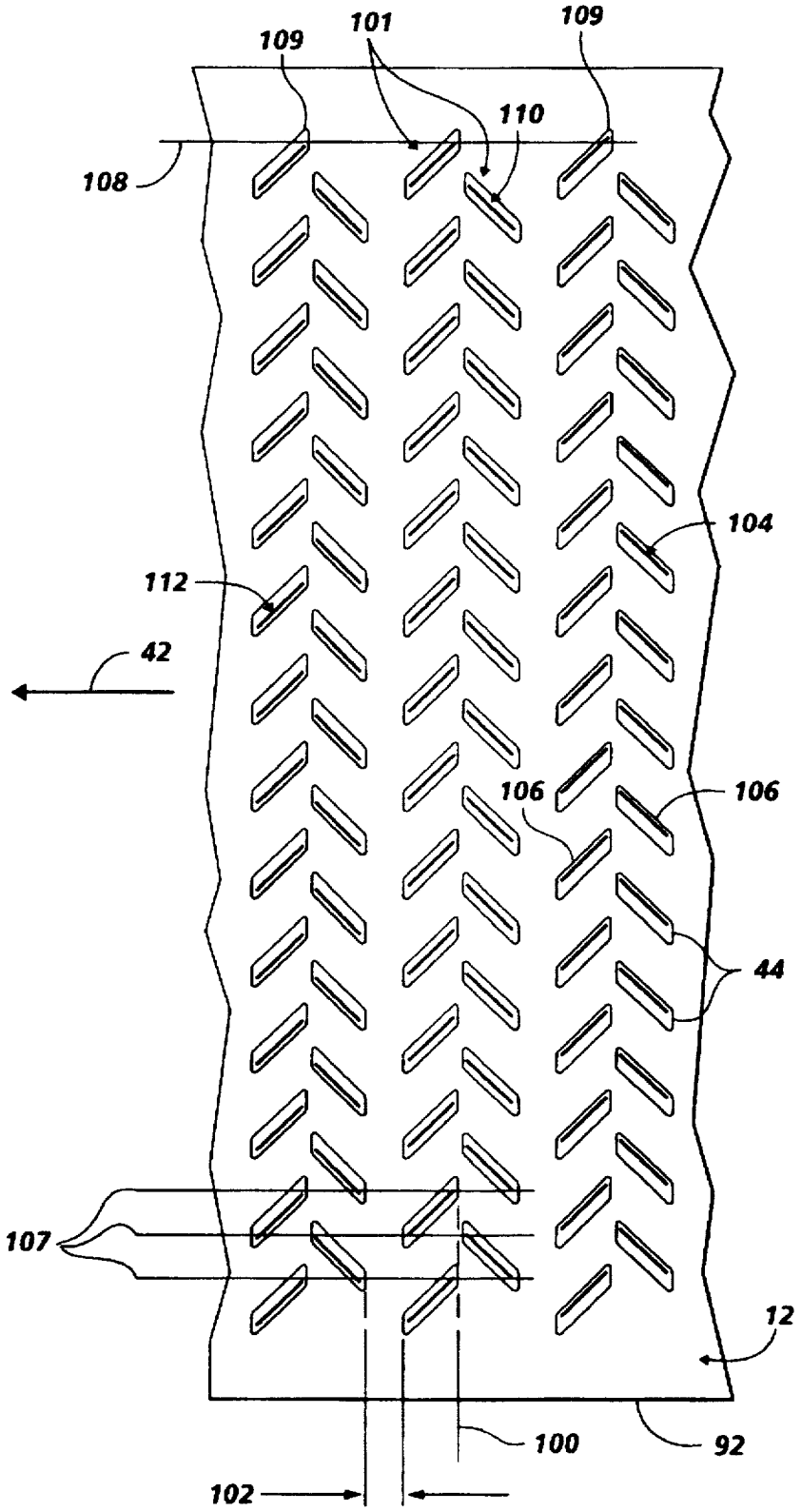
FIG. 9 is a schematic top plan view of the apertures of an ink-jet vacuum transport belt through which the ink-jet printhead has purged the individual nozzles thereof in a drop pattern.

FIG. 9 illustrates a portion of the belt 12 as illustrated in FIG. 8 and the ejection of ink drops through the slots for purging of the ink-jet printhead 16 through the gutters 66. A guttered drop pattern 104 consists of a plurality of individual drops 106 which are deposited through the slots 44 of the belt 12, as the belt 12 moves in the transport direction. Each of the drops 106 within an individual slot 44 are deposited by a different segment or portion of the complete array of nozzles. The nozzles within a single segment discharge through a single slot 44 as the belt moves. Consequently, the portion of the slot above the gutters 66 moves with the nozzles being fired so that ink enters the gutters 66 instead of being deposited on the belt. In the present embodiment, each nozzle ejects ten drops of ink.

As can be seen, each pair 101 of orthogonally placed rows of slots 44 allows for the complete ejection of ink from all of the nozzles of a single print bar. Adjacent nozzles of adjacent segments of the print bar discharge ink in different slots. For instance, a plurality of lines 107, parallel to the belt edge 92 and crossing the line 100, indicates where drops from adjacent nozzles of adjacent segments of the printhead array are deposited. In addition, by generating the drop patterns on a 45 angle, each nozzle firing into a single slot starts a drop pattern one resolution line away from an adjacent nozzle within the same slot if the belt shifts sideways during steering, the drop pattern remains within the width of the slots since belt travel from side to side is controlled to be less than the width of a slot. Since the belt 12 is moving in the transport direction 42, the individual drops 106, as illustrated in FIG. 9, appear as angled lines if printed on a sheet of paper.

In both embodiments of the belt, it should be noted that the repeating pattern of rows provides more latitude in placement of the recording sheet on the belt, since the same holes used for vacuum holddown are also used for purging of the printhead. It is within the scope of the invention, however, to provide a different aperture pattern for purging than for vacuum holddown. In such an embodiment, accurate placement of the recording sheet on the belt requires a sensing mechanism which can distinguish between differing aperture patterns.

The sensor 48 previously illustrated in FIG. 2, is located in a fixed position relative to an end of the gutters 66 and the printbars 16. The sensor 48 is located such that as the belt 12 moves in the transport direction the apertures 44 are sensed along a line 108. An end slot 109 in every other row of individual slots is sensed by the sensor 48 as the end slot in each of the rows passes by the sensor. The drop pattern does not shift relative to the transport direction 42 since printing of a drop pattern begins at the same sensed edge of a slot regardless of belt steering. The slots in the belt are also of a sufficient width to accommodate a slight amount of side-to-side movement of belt position due to manufacturing tolerances and edge guiding tolerances. This side-to-side belt position is shown by the drop pattern 104 being located to the left side of the slots 44. A drop pattern 110 is deposited directly in the center of the appropriate slots when the belt is properly positioned. A drop pattern 112 is deposited to the right of the slots when the belt is out of position to the left. (The belt edge 92 has not been illustrated to show this movement.) Consequently, the present invention not only provides for ejection of inks through the transport belt into an ink gutter over two rows of slots, but also provides for a slight amount of side-to-side belt position change due to various tolerances. It is also possible to monitor side motion of the belt and time the ejection of ink from the printbar according to the monitored motion for purging.

In recapitulation, there has been described an ink-jet vacuum transport system for transporting printed sheets past page-width printheads and through an active dryer. The ink-jet vacuum transport mechanism includes a belt having apertures for purging of the printheads between recording sheets. Though the apparatus has been described for four page-width printheads for the printing of color, the present invention is also applicable to any number of page-width printheads. In addition, the present invention can be used with other types of active dryers. For instance, it is possible to use only the first vacuum apparatus 20 for vacuum hold down and/or purging and not the second vacuum apparatus 28.

It is therefore, apparent that there has been provided in accordance with the present invention, an ink-jet vacuum transport system. While this invention has been described in conjunction with a specific embodiment thereof, it is evident that many alternatives, modifications, and variations will be apparent to those skilled in the art. Accordingly, it is intended to embrace all such alternatives, modifications, and any variations that fall within the spirit and broad scope of the appended claims.

What is claimed is:

1. A printing machine for printing on a recording medium moving in a process direction, comprising:

a liquid ink printhead, including a plurality of nozzles depositing ink on the recording medium; and a transport belt, disposed adjacently to said printhead, moving the recording medium in the process direction and including a plurality of slotted apertures angled with respect to the process direction, said slotted apertures being arranged in a plurality of adjacent rows, the slotted apertures of a first row being substantially orthogonal with respect to the slotted apertures of an adjacent row, said transport belt and the recording medium defining an interdocument region, said liquid ink printhead electing ink in the interdocument region through the plurality of apertures.

2. The printing machine of claim 1, further comprising a vacuum holddown device located opposite to said printhead, applying a vacuum through the plurality of slotted apertures.

3. The printing machine of claim 2, further comprising a dryer associated with said transport belt, drying the ink deposited on the recording medium.

4. The printing machine of claim 3, wherein said dryer comprises a microwave dryer.

5. The printing machine of claim 4, further comprising a roller contacting said transport belt and moving said transport belt through said microwave dryer.

6. The printing machine of claim 5, wherein said transport belt comprises a material substantially transparent to microwave energy.

7. The printing machine of claim 6, further comprising a second vacuum holddown device associated with said microwave dryer applying a vacuum to the recording medium in said microwave dryer.

8. The printing machine of claim 7, wherein said vacuum holddown device comprises a platen adjacent to said transport belt.

9. The printing machine of claim 8, wherein said platen includes a plurality of holes, the holes directing the applied vacuum to the recording medium.

10. The printing machine of claim 9, wherein said platen defines at least one opening aligned with the liquid ink printhead, the opening conveying ink ejected from the liquid ink printhead.

11. The printing machine of claim 10, wherein said vacuum holddown device comprises a vacuum member developing a pressure and cooperating with said platen to define a vacuum chamber, said vacuum member decreasing the pressure within the vacuum chamber.

12. The printing machine of claim 11, wherein the plurality of adjacent rows of slotted apertures are located throughout said belt such that the recording medium can be placed at any location thereon.

13. A method of purging an ink jet printhead in a printing machine moving a recording medium through a print zone in a process direction, comprising the steps of:

moving the recording medium with a transport belt, the transport belt including a plurality of slotted apertures angled with respect to the process direction, said slotted apertures being arranged in a plurality of adjacent rows, the slotted apertures of a first row being substantially orthogonal with respect to the slotted apertures of an adjacent row; and ejecting ink through the slotted apertures during movement of the transport belt.

14. The method of claim 13, further comprising collecting the ink ejected through the transport belt during movement of the transport belt.

15. The method of claim 14, further comprising applying a vacuum through the apertures of the transport belt to the recording sheet moving through the print zone.

16. The method of claim 15, further comprising supporting the transport belt in the print zone with a platen having at least one opening conveying the ejected ink through the platen.

17. The method of claim 13, wherein the plurality of rows are located throughout the belt such that the recording medium can be placed at substantially any location thereon.

* * * * *